United States Patent [19]

Evrard

[11] 3,964,240

[45] June 22, 1976

[54] BOTTLE CLOSING APPARATUS

[75] Inventor: Ernest L. Evrard, Charenton, France

[73] Assignee: Societe Anonyme Machines Automatiques Cillotta, Morangis, France

[22] Filed: Jan. 13, 1975

[21] Appl. No.: 540,493

[30] Foreign Application Priority Data

Feb. 27, 1972 France ..... 72.06616

[52] U.S. Cl. ..... 53/306; 53/317; 53/319

[51] Int. Cl.[2] ..... B65B 7/28; B67B 1/06

[58] Field of Search ..... 53/306, 308, 317, 331.5, 53/319, 361, 367, 364, 365

[56] References Cited

UNITED STATES PATENTS

| | | | |
|---|---|---|---|
| 2,106,365 | 1/1938 | Tiano | 53/306 X |
| 2,705,101 | 3/1955 | Everett | 53/317 |
| 2,731,185 | 1/1956 | Ranney et al. | 53/317 |
| 3,031,822 | 5/1962 | Dimond | 53/317 |
| 3,242,632 | 3/1966 | Dimond | 53/308 X |
| 3,491,516 | 1/1970 | Bergeron | 53/331.5 X |
| 3,818,677 | 6/1974 | Herbert | 53/338 |

*Primary Examiner*—Travis S. McGehee
*Assistant Examiner*—Horace M. Culver
*Attorney, Agent, or Firm*—N. Jerome Rudy

[57] ABSTRACT

An automatic stoppering apparatus for bottles and the like having threaded necks with matching threaded stoppers is adapted upon feed of the bottles into the apparatus wherein they are carried on and by a generally vertically disposed rotating drum to screw the stoppers into sealing engagement with the bottles during rotation of the drum and before discharge of the bottles by means of associated rotatably and vertically movable stopper grasping and attaching heads that cooperate with the rotating drum in operation of the apparatus.

15 Claims, 7 Drawing Figures

BOTTLE CLOSING APPARATUS

BACKGROUND OF THE INVENTION

Various means are well known in the art to close (i.e., stop, cork or seal) by means of threaded closure or stopper units in various containers and vessels, such as bottles, flasks or the like, having openings that are adapted or adaptable to receive same. Thus, especially when the container opening is pre-fabricated so as to have a threaded (particularly an interiorly threaded) neck portion, it is possible to employ for the closure a flexible capsule or sealing device which is insertable in the neck of the threaded container by merely knurling or turning the capsule under suitable inserting force or pressure into the pre-threaded neck opening of the container. Capsules or corks made of suitable plastic materials are particularly well adapted to be used as seals in this way since they are adapted to be securely screwed into the pre-threaded neck so as to provide an adequate seal or closure for the container. An alternative technique done in about the same way is to use a pre-threaded capsule or cork or the like closure device (also advantageously comprised of a suitable plastic material of construction) so as to even more positively assure the efficacious screwing of the stopper into the threaded neck opening of the container so as to make the desired seal.

In the first case, it is necessary at the time of stoppering to assure a pressure between the capsule or closure insert and the vessel so as to compress the container opening to effect the clossure and to maintain this compression during the time that the actual setting or the knurling of the capsule is being done.

On the other hand, when pre-threaded stoppers are employed, the joint or section which is at the bottom of the stopper is compressed at the end of the stoppering action so that it is not actually necessary to apply a vertical force on such a stopper during the container closing operation.

In several of the currently known container sealing machines, the stoppering and sealing devices used nonetheless exert a vertical force on even pre-threaded stoppers during the course of the sealing operation due to the fact that the tightening of the closure or stopper in the involved stoppering head (i.e., the element or section of the machine which actually effects and achieves the stopper inserting and resulting container closing and sealing operation) is a function of the force of applying the stoppper against the container bottle or the like container being stoppered or sealed so that, in order to assure the rotational movement of the stopper until a sufficient tightening torque has been applied for adequate sealing, it is generally necessary to employ a vertical force on the stopper during the stoppering operation. It has been found that the existence of this vertical force, particularly in cases where the threaded portion of the stopper has a relatively small pitch (i.e., a widely spaced threading), leads to functioning inconveniences and difficulties. For example, these may be manifest by a blockage or locking of the stopper on the threads of the container neck opening with which it is adapted and supposed to mate. This blockage tends to at least partially, if not completely, prevent the proper screwing on of the stopper and oftentimes subsequently causes later deteriorations and spoilage and/or leakage of contents of vessels thus imperfectly stoppered and sealed due to loss of contents from or entry of air into such poorly stoppered containers, especially during the course of transportation and other movement thereof.

A stoppering or sealing has also been heretofore suggested in which the stoppering head or closure performing element is supposedly adapted to assure lateral tightening of a pre-threaded stopper independently of the force applied by the stopper onto the container neck opening. In this machine, the stoppering head (or bottle closure inserting or applying) unit includes a piston which moves directionally parallel to the axis of the thread of the neck to be stopped. In this way, the piston acts during the closing on and in cooperation with a ring that is ordinarily made of a flexible rubbery or elastomeric material which presses against the side wall of the stopper during the actual closure of the container so as to permit rotational advancement of same without its being necessary for the stopper to have any vertical support force or pressure applied on the stopper and its associated neck. However, in such machine, the flexible ring which contacts and more or less encloses the stopper or closure element and which is subjected to the action of a piston is a one-piece affair which generally tends to deteriorate rather rapidly. It thus most often requires frequent replacement and therefore constitutes a great inconvenience and brings about distinct disadvantage in its use.

DESCRIPTION AND CHARACTERIZATION OF THE INVENTION

The purpose and general objective of the present invention is to provide a machine or apparatus designed for the very efficient and effective closure or stoppering of various containers, flasks and vessels by means of pre-threaded stoppers or closure elements, which apparatus is most desirably and beneficially adapted to effect the container stoppering and sealing of the container without exerting any vertical fulcrum force of the stopper on the neck so as to avoid any necessesity for frequent replacement of any portion or functional element in or associated with the stoppering head or closure unit that is employed.

The essential subject matter of the present invention is a new and particularly useful industrial product and contribution comprised of the presently described bottle or the like or equivalent container closure apparatus or stoppering machine which makes it readily and advantageously possible to automatically screw on prethreaded stoppers into a neck of a container or vessel; the feeding and removal of the containers into and out of the apparatus being conducted by means of a chain or equivalent conveyor.

The apparatus of the present invention is basically comprised of a drum that is driven by a roughly vertical axle which turns on a fixed frame. The drum holds or contains, at regularly spaced intervals on its periphery, a number of stoppering elements or closure units, all of which are identical. Each of the stoppering elements is associated with a feed arm for supply of the stoppers. The feed arm receives the stoppers as they are delivered to it in sequential one-by-one fashion by a holding system therefor from the exit ramp of a distributing element for the stoppers. Each stoppering unit or element has, for its actuation and operation, an associated drive cylinder which moves in direction that, as required, are both: on one hand in a manner of direction parallel to and along the axle of the drum; and, on the other hand, in a rotational movement around its own axle. The drive cylinder is generally an actual integral part of the stopper head unit by virtue of having therein and therewith provided a limiting couple. The stoppering head has pivoting jaws which are designed to pick up and/or grasp each stopper as it is being supplied by the stopper feed arm or bar. Each of the stoppering heads in the apparatus is further characterized by the fact that they have and are provided and made up of and with a pivoting jaw support with respect to which a concentric, inflexible ring can be moved under the effect and influence of at least one fluid-powered drive cylinder or jack and at least one closely-coiled spring. Although equivalent actuating means that are known and suitable for the purpose may also be employed, the use of fluid-powered — especially pneumatic — cylinders or jacks is generally sufficiently advantageous so as to be preferred for utilization in apparatus according to the present invention. The drive for the jaws support is thus accomplished by means of and with the drive cylinder through a corrugated piece or object with respect to which the jaws support is so relatively positioned and displaced as to have sufficient room for both its axial and radial movement.

In a preferred and highly beneficial embodiment and design of apparatus in accordance with the present invention and bottle closure apparatus development, the centering of the jaws support with respect to the corrugated piece is accomplished through and by means of a projection which is in the form of a truncated cone, the male element of which is formed on one side of the corrugated piece and the female element of which is an integral segment or part of the jaws support. The concentric ring which controls the jaws of the stoppering head is most desirably subjected to the effect of three pneumatic cylinders or jacks which are arranged at respective angular displacements of 120° one from the other and fed by the same transmission system that is positioned and so as to be correlatively disposed and arranged according to the axle of the drive cylinder. The concentric ring which controls the jaws of the stoppering head is also subjected to the effect of the three closely-coiled springs that are likewise arranged so as to have 120° spacing angles between one another. The three closely-coiled springs themselves are displaced by angular spacings of 60° with respect to the three pneumatic jacks that act on the ring. The actual axial positioning of the stopper with respect to the jaws support is controlled by a screw head which forms a stop and is arranged according to and in effective relationship with the axle of the jaws support in the area marked off or delineated by the jaws.

In the advantageous embodiment preferred, the jaws of the stoppering head are automatically brought into their opening position by means of its associated close-coil spring. The rotational movement of the drive cylinder of the stoppering head is obtained by the rolling action of a gear on a rim of a gear wheel which is solidly connected to the frame of the apparatus. The vertical movement of the drive cylinder is obtained by the cooperation of a roller solidly connected to the cylinder but which does not turn around the axle of the said cylinder all in cooperation with a camway which is in one-part integral association with the framework. The movement of the stopper feed arm that is associated with each stoppering head is obtained by a cam which is also part of the frame. The feeding of the drive cylinder jacks of each stoppering head is controlled by an arm associated therewith that is moved by the drum, the necessary correlated maneuvering motion of the arm being due to and achieved with the cooperation of a control device that is connected to the arm and an associated cam that is connected to the frame.

PARTICULARIZED EXEMPLIFICATION OF THE INVENTION

The many meritorious objectives and advantages of the present invention are evident in what is above disclosed and indicated are even more readily and abundantly discernible and comprehensible in and from the following further description and explanation, all of which (although it does delineate a practical working illustration of the invention) is also purely illustrative and not intended to be limiting of the invention, taken in connection with the associated Drawing, wherein:

FIG. 1, in a general schematic representation, shows a general plan view of the surface of a machine in accordance with the present invention;

FIGS. 2*a* and 2*b* are cross-sectional views, taken from the line identified as II — of FIG. 1, which are respectively arranged so that FIG. 2*a* particularly depicts and defines the top and upper portion of the apparatus and FIG. 2*b* the bottom and lower portion of same;

Figure 3:
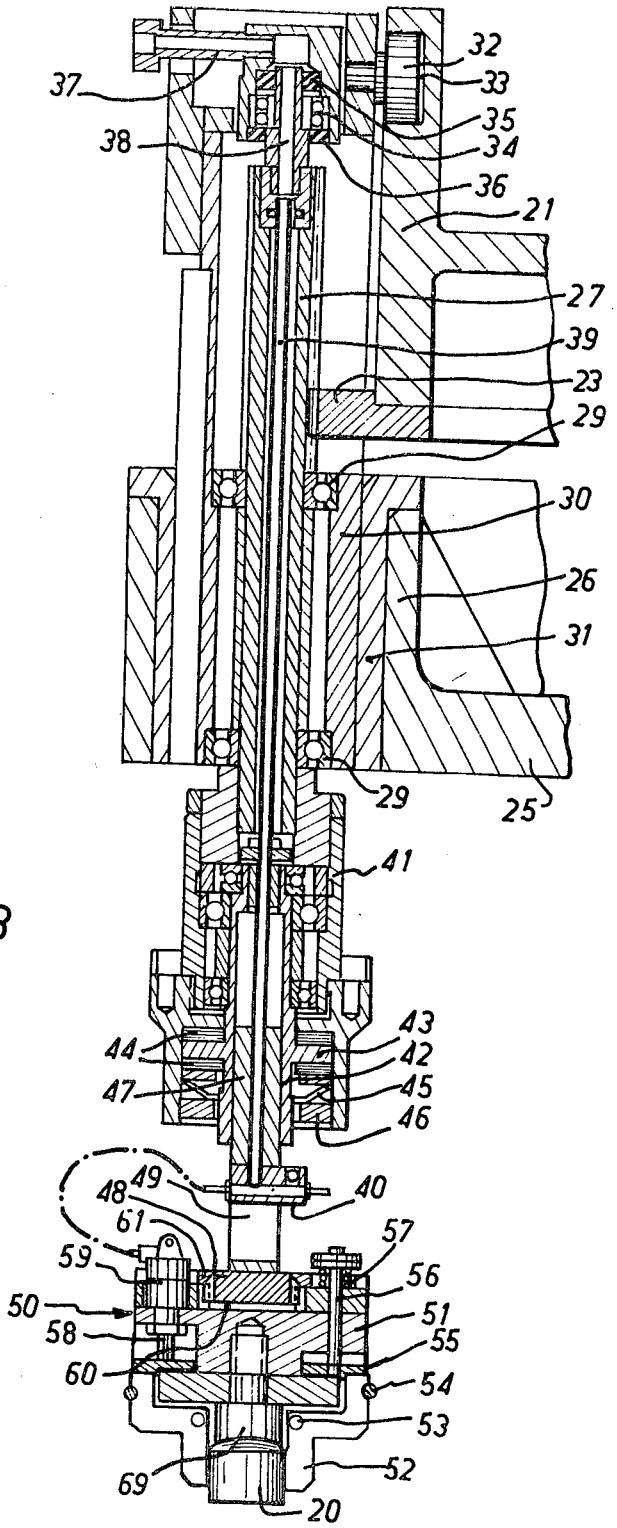
FIG. 3 represents in detail the stoppering element of the drum of an apparatus according to the invention, the clamps of which are shown in a closed position with the stopping head being at its uppermost or the top position.
Figure 5:
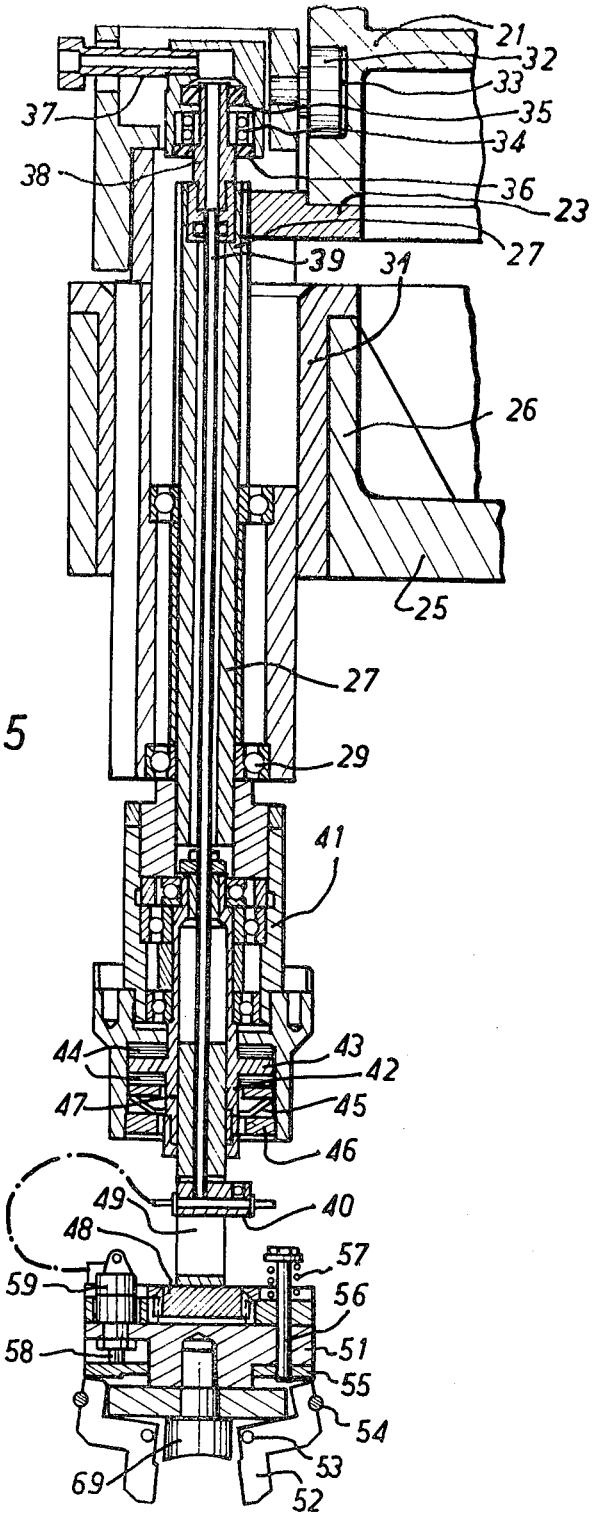
Figure 6:
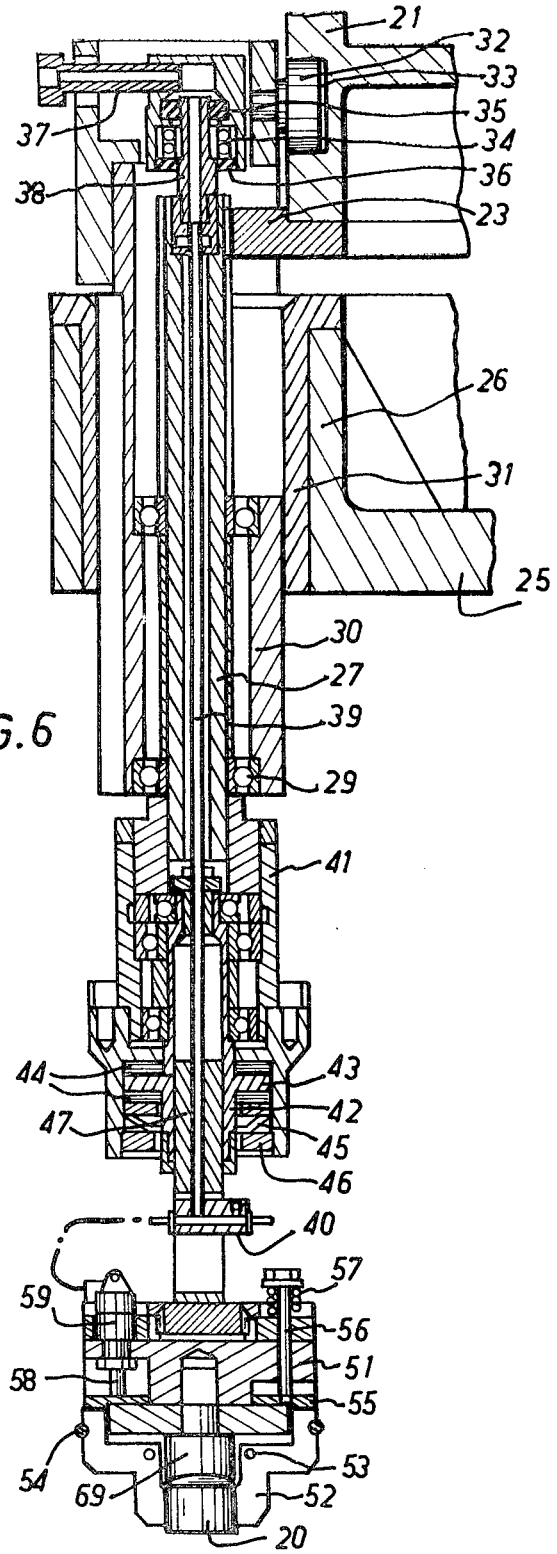

FIG. 5 more particularly depicts the element of FIG. 3 when its head is in the lower position and the jaws thereof are being opened; and FIG. 6 represents the element of FIG. 3 when the head portion of it is disposed in the lower position and its jaws are being closed.

Figure 1:
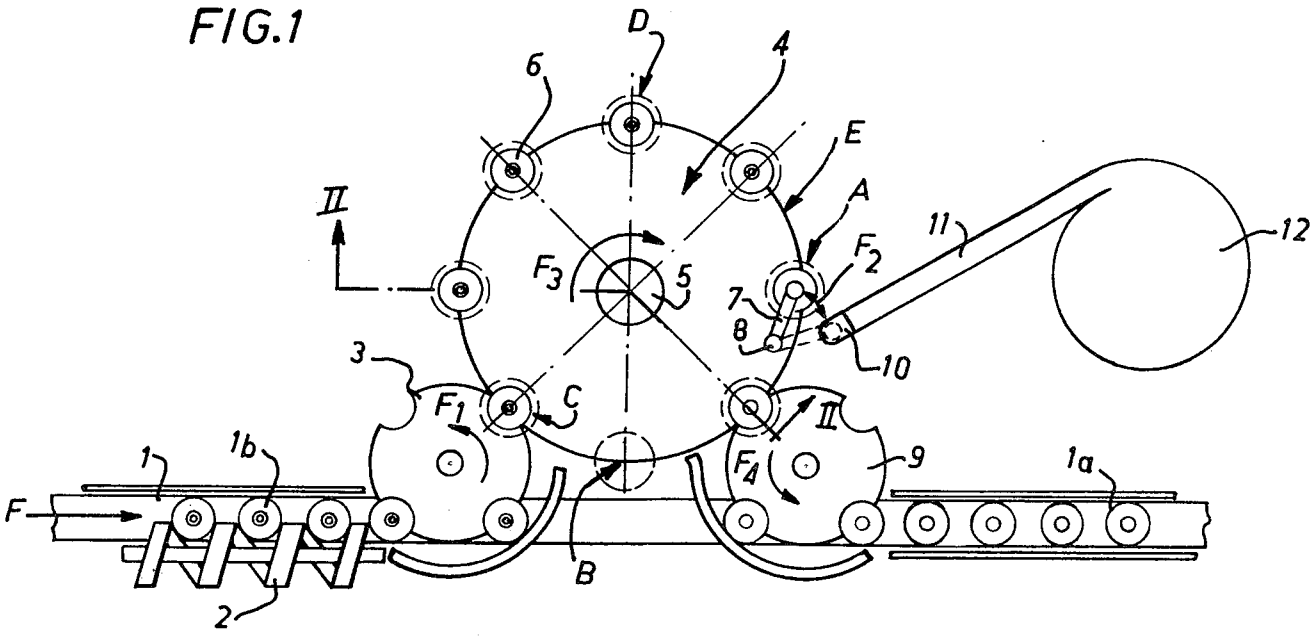

With more specific reference now to the Drawing, there is shown in FIG. 1 a conveyor chain designated by the reference numeral 1 which brings and delivers in the direction of arrow F the bottles or other containers 1*b* that are to be stopped or provided with the desired sealing closures. The bottles have threaded necks and quite frequently are made of glass although containers of any desired material of construction may be sealed and closed with apparatus in accordance with the present invention. The bottles or other containers are appropriately designed to be stopped by means of a stopper made of a molded plastic or equivalent material, with the stopper having on its inside a pre-formed or pre-moulded threading which corresponds to and matches the threading of the container neck opening of the bottles or other vessels to be stopped. The conveyor chain 1 cooperates with an endless screw 2 whose axle is parallel to the axle of said chain so that the bottles are thereby supplied to a roller 3 which turns about it own axis in the direction of arrow F1. The bottles are thus supplied opposite drum 4 of the apparatus, which drum is rotatably driven around its axle by the shaft 5 of the machine apparatus. The drum has, at 60° intervals, a stopping element or unit which is schematically represented in FIG. 1 by reference numeral 6. With and for each stopping element 6 there is associated a feed arm 7 for the stoppers. The feed arm is adapted to pivot around axle 8 in the angular direction of play or movement indicated by the arrow F2.

Drum 4 of the apparatus turns in the direction illustrated by arrow F3 and it carries bottles that have been fed by roller 3 to be removed from the apparatus by means of roller 9 after having followed an angular path or travel in the rotation or displacement of the drum 4 of approximately 300°. The roller 9 turns on its vertical axis in the direction of arrow F4 and brings the closed and sealed stopped bottles or other containers onto the transport chain 1*a* which is arranged in the extension of chain 1 in order to carry away the stopped bottles out of the apparatus. The stopper feed arms 7 may assume the position represented by the dotted line in FIG. 1 so that their extremities are opposite the holding system 10 of exit ramp 11 of a vibrating distributor 12 which may be of the conventional, known variety or type. Further, according to conventional and known means, the apparatus is also advantageously equipped with safety micro or equivalent contacts so designed as to avoid feeding stoppers whenever there is no container present to be closed in the roller element 3. These are not shown.

Apparatus in accordance with the invention has a frame designated by reference numeral 13 in its general construction. The frame 13 is comprised of a base 13*a* on which there are attached vertical support columns 14. The upper parts of the support columns 14 are connected by a crown 15 in the center of which there is provided a bearing 16 through which the upper part of shaft 5 passes.

On the upper portion of framework 13 there is a crown attached which is centered around axle 5. The crown has an exterior edge 17*a* which plays or acts upon the roll of a camway for the roller 18 that is arranged on the outside of an arm 19. The arm 19 is solidly attached to axle 8 of the stopper feed arm 7.

Figure 2A:
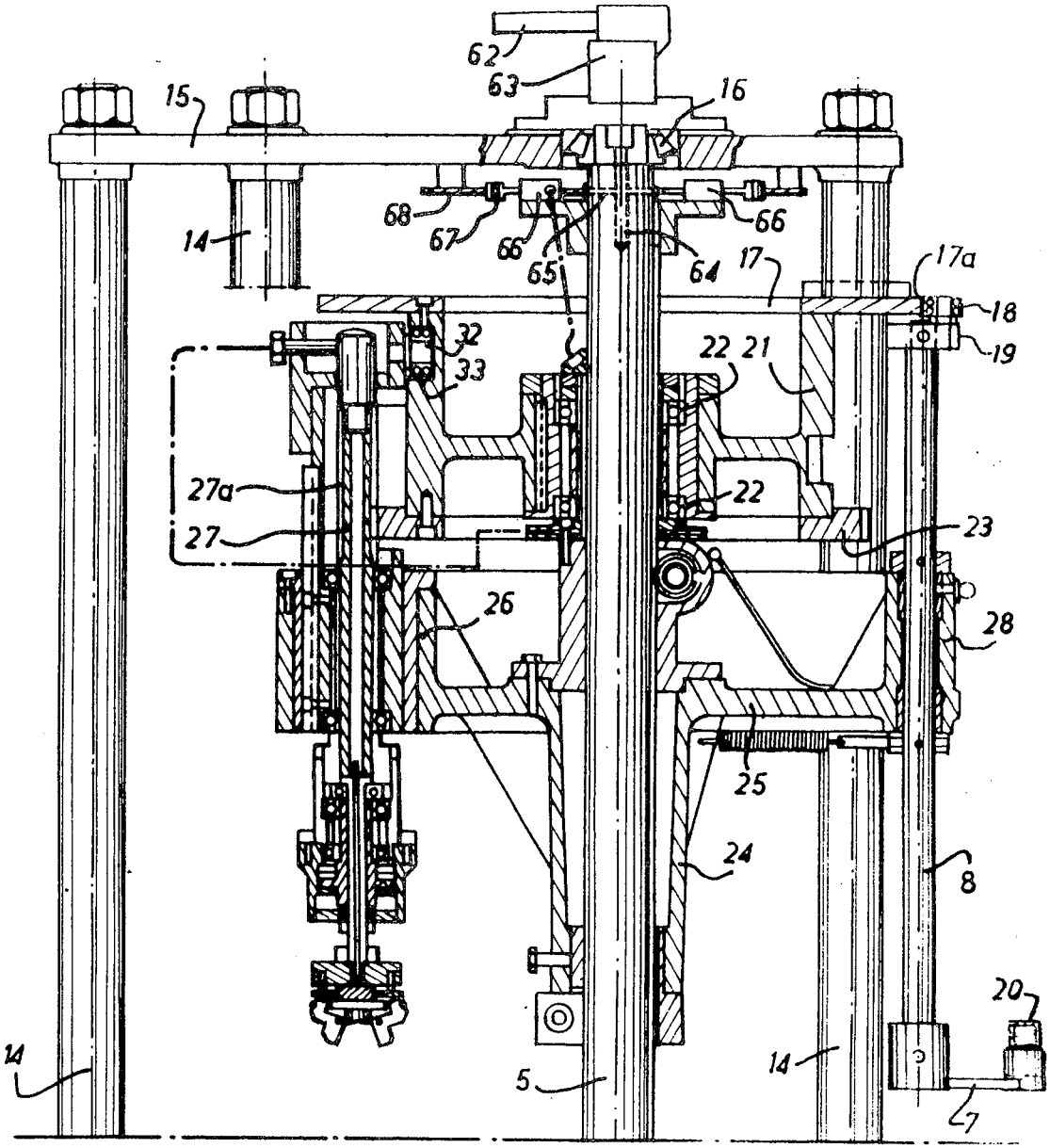
Figure 2B:
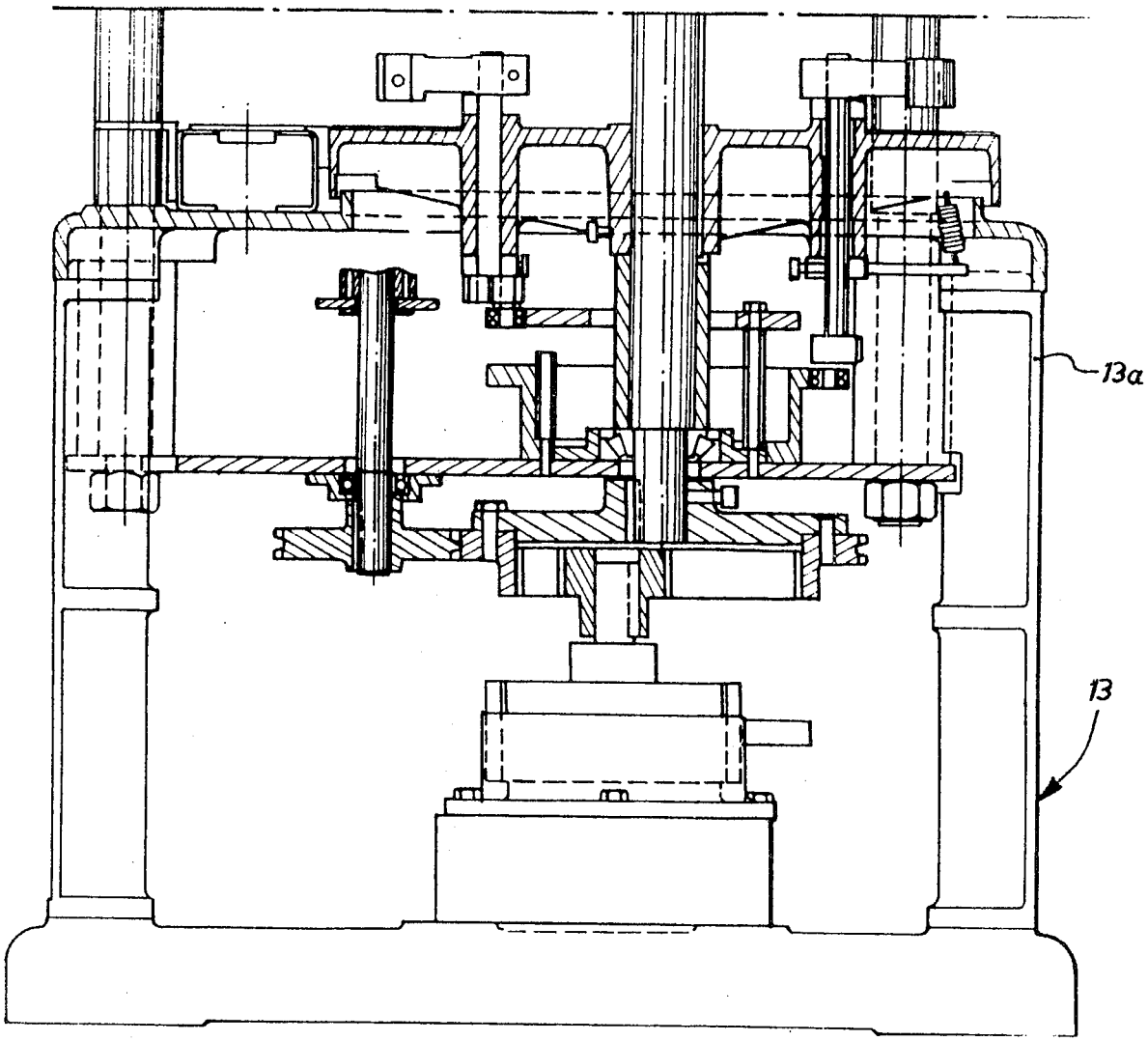

There is shown on the right hand side of FIG. 2 an arm 7 which carries a stopper or closure element 20 for sealing the containers. Below the ring 17, there is located a cylindrical support piece 21 which is centered on shaft 5 by means of bearings 22 with a toothed ring 23 being on the lower part of the cross piece 21. Shaft 5, in its rotational movement, drives drum 4. The drum is made up of a sleeve 24 which is integral with shaft 5 and also with a disc 25 (which may be one-piece with the sleeve, as shown, if desired) that is perpendicular to shaft 5. On the periphery of disc 25 there are arranged at 60° intervals a plurality of axle sockets 26 which are parallel to the axle of shaft 5. These sockets hold the stoppering elements that are schematically represented by reference numeral 6 in FIG. 1.

Each stoppering element or unit has a drive cylinder 27 whose exterior surface constitutes a cylindrical meshing so as to be adapted to cooperate with the toothed ring fixed at the point designated by reference numeral 23 so that the rotation of disc 25 when it is being driven by shaft 5 causes rotation around its axle of the drive cylinder 27 of each stoppering element 6 of drum 4. Between the sockets 26 disc 25 has sockets 28 the inside of which is a bearing for each of the axles 8 pivot of the stopper feed arms associated with each stoppering element or unit of the drum.

With particular reference to FIGS. 3 through 6, it can be observed that drive cylinder 27 of each stoppering element can turn in the socket due to the interposition of bearings 29 which are arranged between the drive cylinder 27 and the sleeve 30 which is capable of sliding vertically on the inside of a sleeve 31 which is arranged in each of the sockets 26.

The vertical sliding of the drive cylinder is obtained by means and as a result of its cooperation with a roller 32 which is integrally connected on the upper part of the drive cylinder and of the cam pathway 33 made in the exterior lateral wall of the cross member piece 21 arranged between the rings 17 and 23. Following the path of the cam 33, it is apparent that axial movement of drive cylinder 27 is readily caused and achieved as a result of the action of the teeth 27*a* of the mesh cylinder of drive cylinder 27 sliding perpendicularly to the level toothed ring 23.

The upper portion of drive cylinder 27, therefore, does not turn around the shaft of the said cylinder 27. There exists between the two parts a coupling device which can turn and which is made up of ball bearings 34 and two sealing couplings 35 and 36. In the upper part of the drive cylinder, (i.e., The portion or part of which does not turn around the axle of the said cylinder) there is the opening of a feed channel 37 for compressed air. The compressed air is conducted through the channel or passageway as far as tube 39 which is arranged to be disposed in the direction of the axle of drive cylinder 27 which, as shown, is rotated about its own axle. On its lower part, channel 39 has a distributor mouth piece 40 with three outlets emanating therefrom. Drive cylinder 27 is integral in it's movement with sleeve 41 which drives socket 42 by means of a limiting element. The limiting element is made up of a disc 43 integrally connected with socket 42 and held between two friction washers 44. The gripping pressure for the washers is regulated by means of a known "Bellville" (or equivalent type of) washer 45 and a screw 47 which is screwed within the inside of sleeve 41.

On the inside of socket 42, there is screwed a cylindrical piece 47 the lower part of which is made up of a channeled piece 48. The lower part of piece 47 has a square hollowed out in it. Another screw having a square central hole is screwed into the bottom of piece 43 so as to hold piece 47 towards the bottom. The drive of piece 47 by socket 42 is brought about by means of a squared section zone. The distribution mouth piece 40, which is in fixed position with respect to pieces 47 and 48 has a slot 49 provided therewith which allows and facilitates the movement of piece 47–48 with respect to mouth piece 40.

The control of the height of the assembly of the six screwing heads is brought about by means of the movement of the assembly 24–25–26 with the shaft 5, a movement which is obtained by manipulating a pinion that is placed below bearing 22 and supported on a rack which is located on the inside of the longitudinal key of shaft 5.

By means of channeled piece 48, the drive cylinder 27 drives the stopping head, designated generally by reference numeral 50. Each stoppering head 50 has a jaws support 51 which carries arms 52 which each pivot around an axle 53. The jaws are surrounded by holding coil circular spring 54 which automatically returns them to the open position. The upper portion of jaws 52 is supported against the ring 55 which is an integral part of the three guide rods 56. The rods are pushed towards the top by means of springs 57 which are located between the extremity of rod 56 and the upper surface of the jaws support 51. Ring 55 is subjected to the action of pistons 58 from three single-action fluid-powered cylinders or jacks 59; with the three jacks being positioned displaced angularly from one another at 120° intervals, as is also the case for the three rods 56 with each of these rods being located at 60° spacings with respect to the three jacks 59.

The feeding for power actuation of the three jacks 59 is done from the mouth piece 40 with, from and through its three openings. In other words, the compressed air for actuating the cylinder jacks is fed through channel 37 of each stopping element.

On its upper part, each jaws support 51 has a reamed out area 60, the lateral wall of which has grooves therein. The grooves of the reamed out area 60 cooperate with the peripheral grooves of the grooved piece 48. The grooved piece 48 is enclosed within the reamed out area 60 by reason of a segment 61 which has, opposite 48, a truncated wall. Piece 48 has, opposite segment 61, a truncated projection of the same corresponding angularity. The height of piece 48 is below the level available between segment 61 and the bottom of reamed out area 60. Moreover, an area of moveability or play is located radially between the grooves of reamed out area 60 and the grooves of piece 48. In this way, each of the jaws supports 51 can have both an axial and a radial play with respect to groove piece 48; it actually being even possible to have the same inclined with respect to the axle of piece 48 and the drive cylinder 27.

The pneumatic feed of the cylinder jacks 59 for each stoppering element is done by a unique feed 62 system for the apparatus which is placed at the end of shaft 5. The pneumatic air feed is accomplished by means of a turning coupling 63 that is disposed in the direction of an axial reamed out or enlarged portion 64 which is made in shaft 5. The reamed out portion 64 feeds a plurality of corresponding radial reamed out portions 65 that are matched with each stoppering element. Each of the reamed out areas 65 feed the entry of an arm 66 which is controlled by a roller 67 that rests against the fixed cam 68, the cam being an integral part of the plate of the frame. The outlet of arms 66 is made along the shaft 5; and the corresponding grooves again top out below the sleeve which is held by bearings 22 and are connected by the flexible tubes (symbolized by dashes) in the grooves 37 that are supported by each of the stoppering elements.

It is thus apparent that depending upon the position of the stoppering element with respect to the axial level at any given fixed reference point, the action and effect of cam 68 controls the feed or lack thereof of the jacks 59 in any stoppering head 50 which corresponds to any particular stoppering element involved. When the movement of the jacks 59 is complete (i.e., when they have completely yielded), ring 55 is pushed down so as to hold the jaws 52 on stopper or closure element 20 which is positioned in place beforehand between the jaws by the stopper feed arms 7. The axial position of stopper 29 with respect to the jaws support 51 is controlled by means of a screw head 69 with the said screw cooperating with the interior threading of a recessed area made to conform to and be in alignment with the support axle of jaws 51. Whenever the feed from the fluid-powered cylinder jacks 59 is cut off, the springs 57 bring washers 55 into the top position and action of the spring 54 assures the opening of jaws 52. Screw 59 and jaws 52 are shaped to accommodate the physical form of the stopper 20. Of course, appropriately dimensioned and sized parts can readily be provided whenever the form and the dimension of the closure element stopper to be screwed in for container sealing are changed.

In the position of the stopping element indicated by the letter A in FIG. 1, the pivoting of feed arm 7 effectuates the appropriate grasping of each stopper 20 from the holding system 10 and subsequently, before reaching the position indicated by letter B, the movement of the stopper opposite the axle element of the corresponding stopping.

By action of cam 33, stoppering head 50 is caused to move towards stopper 20. The jacks 59 are fed or actuated so as to grasp the stopper. The stoppering head 50 is then caused to move upwards as a result of the action guided by the form of cam 33. This brings about the effacing of arm 7 as a result of the form of cam 17*a*, with the pneumatic feeding for actuation of jacks 59 of each stoppering head in question being all at the same time maintained. When each stoppering element in question has arrived roughly in the area designated by letter B in FIG. 1 and the position of the various organs of the stoppering element is as represented in FIG. 3, the area located opposite the stoppering head in question is free and open for the arrival and reception of the bottle or other container to be stopped or sealed with the threaded closure element.

The container is passed along by roller 3 into the zone marked by letter C in FIG. 1; and the descent of head 50 is initiated as a result of the function of cam 33. The controlling of the apparatus is brought about in such a way that the stopper comes into correspondence with the level of the neck. The play existing between the hollowed out area 60 and the grooved piece 48 makes is possible for adaptation of the stopper to the neck without any vertical force being exerted on the stopper. Head 50 is moved around and the stopper is screwed into the neck until the holding element causes the limiting element 43–44 to slip. The end of the sealing closure or stopper is obtained in the area designated by the letter D in FIG. 1 and the constituent elements of the corresponding stoppering element are in the position represented in FIG. 6. The power feed supply of the cylinder jacks 59 is cut off by means of the result of action caused by the shape of cam 68. This then makes it possible to open jaws 52 and stop the slipping of the limit element 43–44. The position of the constituents of the corresponding stopping element is shown in FIG. 5.

Figure 4:
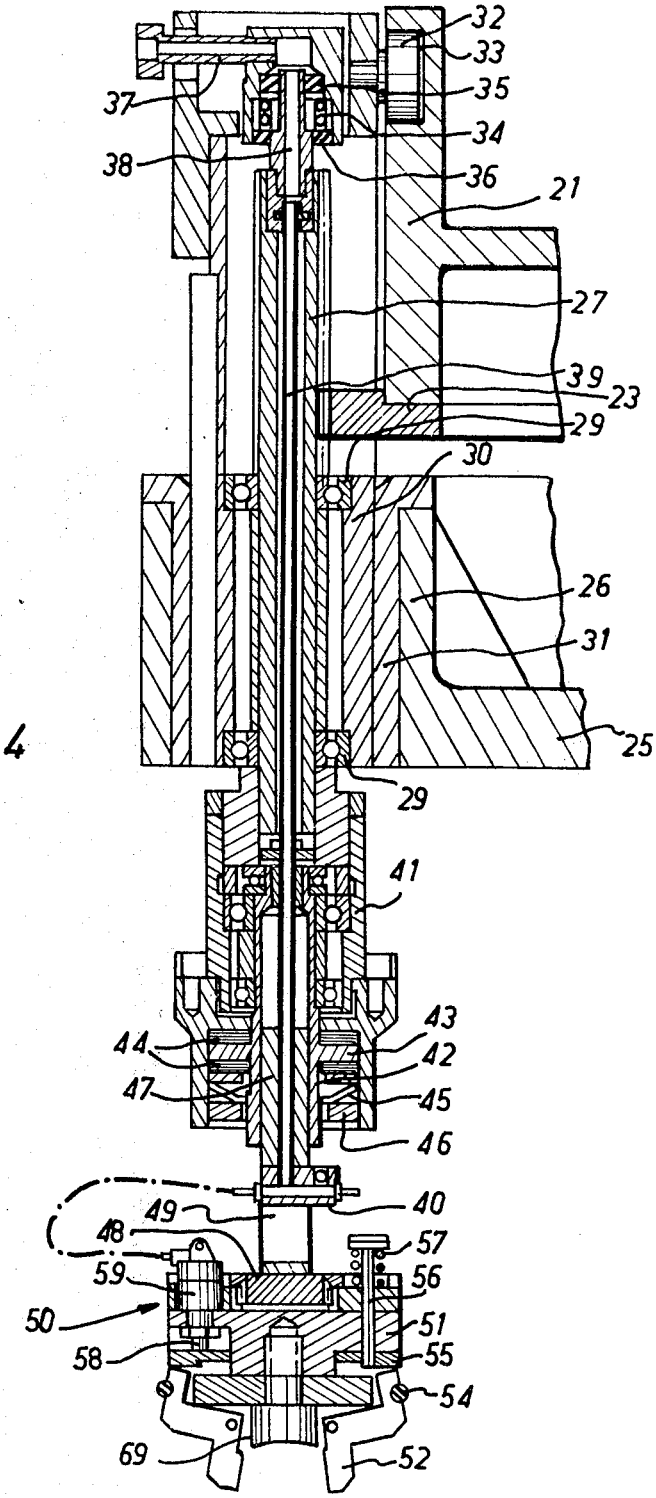
FIG. 4 shows the stoppering element of FIG. 3 when the head thereof is in the top position and the jaws are open.

The return to the original or starting position of each stoppering head 50 is accomplished by influence of action resulting from the form of cam 33 in order to release the stoppered and sealed and closed bottle or other container. This release is made in the area marked by the letter E in FIG. 1. The position of the constituent parts of the stoppering element is then as is represented in FIG. 4.

The cycle of container closing operation is continued by once again grasping or taking up, whenever the stoppering element is in position A, a stopper at the extremity of arm 7; then releasing the stoppered and sealed bottle by means of roller 9 by causing arm 7 to pivot in order to pass along the stopper which has just been grasped opposite the stoppering head and realigning the said stoppering head as indicated previously prior to the position marked B in FIG. 1.

It is readily discernible that such an arrangement makes it possible to stopper and seal vessels having a threaded neck by means of pre-threaded stoppers without encountering the problems and likelihood of breakdowns even when very rapid container closing and sealing operations, using the machinery at maximum speed, are engaged in with an apparatus in accordance with the present invention.

In fact, the stoppering head 50 is practically floating opposite the grooved piece 48 which controlls it. Thus, regardless of the physical form, configuration and appearance of the stopper on the corresponding neck opening of the container, this feature assures satisfactory screwing in because of the absence of any vertical support force or pressure of the stopper on the neck. In this connection and as a matter of fact, it is alternatively possible to utilize apparatus of the presently-contemplated general type according to the present invention for the closure of containers having exteriorly threaded neck openings using, cap-like internally threaded stoppers or closure elements; even through the present development has not been herein specifically illustrated accordingly. Moreover and as a very desirable aspect of the invention, in the stoppering head of apparatus according to the invention, there is as has been pointed out no flexible piece subject to quick wear and deterioration so that maintenance operations necessary for good function of the presently contemplated automatic container stopping and sealing apparatus to a minimum.

It is of course obvious that the above particularly described mode of operation is intended to be merely illustrative and in no way limiting. Many changes and modifications can readily be made and adapted in embodiments in accordance with the present invention without substantially departing from its apparent and intended spirit and scope, all in pursuance and accordance with same as forth set orth and defined in the hereto appended claims.

What is claimed is:

1. Apparatus for stoppering and providing sealing closures for containers and the like which have threaded neck openings and which are adapted to receive for their stoppering corresponding pre-threaded stopper closure elements each of which make screwed engagement with the neck opening to effect the sealing of the container, which apparatus comprises in cooperative combination:

mechanical conveyor means for feeding into the apparatus the containers to be stoppered;

a generally vertically disposed rotatable drum adapted to be turned when driven and further adapted to hold and carry containers with it when said containers are fed into the apparatus to the drum;

means associated in engagement with said drum for driving same;

a frame fixed with the drum having at least one stoppering head element regularly distributed on its periphery;

each of said stoppering heads being in association with a corresponding stopper feed arm that is adapted to receive individual stoppers fed to it;

means for feeding stoppers to each of said stopper feed arms;

each of said stoppering heads having a drive cylinder that is in integral association with said drum and further adapted to move both parallel with and rotatable about the axle of said drum;

an intermediate limiting means in connection with each of said stoppering heads for effecting its integral association with said drum driving means;

each of said stoppering heads having a pivoting jaws support having jaws thereon adapted to grasp individual stoppers fed thereto from said stopper feed arms;

each of said pivoting jaws supports being provided thereon with a non-flexible concentric ring and at least one associated fluid powdered cylinder jack, said ring being so located as to be subject to the actions of said associated fluid-powered cylinder jack and an associated coil spring which automatically moves said jaws into their open position;

each of said pivoting jaws supports being also provided with means to move same by said drive cylinder which means consists of an associated, engaged grooved piece with which each support is given both axial and radial movement; means for closing each of said jaws supports to grasp each stopper fed to it and hold it secure for sealing screwing thereof with the threaded neck opening of each container to be sealed while being carried by said drum upon rotation of said drum;

means for releasing each of said jaws supports at the appropriate point of rotation of the drum when each stopper has been screwed to the container neck opening, whereupon said drum then discharges each of said stoppered and sealed containers to mechanical conveyor discharge means for removing same from the apparatus.

2. The apparatus of claim 1, wherein said container-feeding mechanical conveyor means and said mechanical conveyor discharge means for removing the stoppered containers are in the form of a container-carrying conveyor chain.

3. An apparatus in accordance with the apparatus of claim 1, wherein said jack is a pneumatic jack.

4. An apparatus in accordance with the apparatus of claim 1, wherein the moving means for each of said jaws supports is centered with respect to said grooved piece by means of a truncated projection thereon forming a male element which is an extremity of said grooved piece, the female element for which is an integral part of the jaws support.

5. An apparatus in accordance with the apparatus of claim 1, wherein said concentric ring which controls the jaws is subjected to the effect of three pneumatic cylinder jacks displaced angularly with about 120° spacings in between one another and to which compressed air for actuation is fed thereto through a single passageway channel disposed concentrically along the axle of each drive cylinder.

6. An apparatus in accordance with the apparatus of claim 5 and further characterized in that said concentric ring which controls the jaws is further subjected to the effect of three close coil springs displaced angularly with about 120° spacings in between with respect to one another which are also each angularly displaced from each of said adjacent jacks by about 60°.

7. The apparatus of claim 1, wherein said drive cylinder head is adapted to be rotated by means of a cylindrical mesh bearing on a toothed ring which is an integral part of said frame, with a roller which is integrally fixed to said cylinder but which does not revolve about the same axis as that of said cylinder; and a cam integrally fixed on said frame, whereby the vertical movement of said drive cylinder is achieved by cooperative interaction of said roller and said cam.

8. An apparatus in accordance with the apparatus of claim 6, wherein said drive cylinder head is adapted to be rotated by means of a cylindrical mesh bearing on a toothed ring which is an integral part of said frame, with a roller which is integrally fixed to said cylinder but which does not revolve about the same axis as that of said cylinder; and a cam integrally fixed on said frame, whereby the vertical movement of said drive cylinder is achieved by cooperative interaction of said roller and said cam.

9. The apparatus of claim 1, including therein cam means integrally associated with said frame, which cam means are adapted to cause movement of said stopper feed arm for supplying the stoppers individually to be grasped by the stoppering head (s) on said frame during rotation of said drum.

10. An apparatus in accordance with the apparatus of claim 6, and including therein cam means integrally associated with said frame, which cam means are adopted to cause movement of said stopper feed arm for supplying the stoppers individually to be grasped by the stoppering head (s) on said frame during rotation of said drum.

11. An apparatus in accordance with the apparatus of claim 1, wherein the fluid power supply to each jack has control means therefor, which control means consist of a movable arm carried by said drum which arm is caused to be moved during rotation of the drum by a control element affixed in combination with said control arm which control element is actuated for its movement by contacting engagement with a cam affixed to said frame.

12. An apparatus in accordance with the apparatus of claim 6, wherein a fluid power supply to each jack is provided and has control means therefor, which control means consist of a movable arm carried by said drum, which arm is caused to be moved during rotation of the a control element affixed in combination with said control arm which control element is actuated for its movement by contacting engagement with a cam affixed to said frame.

13. An apparatus in accordance with the apparatus of claim 9, wherein the fluid power supply to each jack has control means therefor, which control means consist of a movable arm carried by said drum which arm is caused to be moved during rotation of the drum by a control element affixed in combination with said control arm which control element is actuated for its movement by contacting engagement with a cam affixed to said frame.

14. The apparatus of claim 1, adapted to close and seal containers having interiorly threaded neck openings with closure element stoppers that are provided with matching exterior threads so as to be screwable into said openings.

15. An apparatus in accordance with the apparatus of claim 14 adapted to close and seal glass bottles having interiorly threaded necks with matching exteriorly threaded plastic stoppers.

* * * * *